US009494019B2

(12) United States Patent
Wold et al.

(10) Patent No.: US 9,494,019 B2
(45) Date of Patent: Nov. 15, 2016

(54) ANCHOR FOR A TUBING STRING AND METHOD

(75) Inventors: Shaun Arthur Wold, Cochrane (CA); Michael John Derkach, Lloydminster (CA)

(73) Assignee: EVOLUTION OIL TOOLS INC. (CA)

( * ) Notice: Subject to any disclaimer, the term of this patent is extended or adjusted under 35 U.S.C. 154(b) by 491 days.

(21) Appl. No.: 13/233,745

(22) Filed: Sep. 15, 2011

(65) Prior Publication Data

US 2012/0061099 A1 Mar. 15, 2012

Related U.S. Application Data

(60) Provisional application No. 61/383,270, filed on Sep. 15, 2010.

(51) Int. Cl.
*E21B 43/10* (2006.01)
*E21B 43/12* (2006.01)

(52) U.S. Cl.
CPC ..... *E21B 43/10* (2013.01); *E21B 43/126* (2013.01)

(58) Field of Classification Search
CPC ..... E21B 43/10; E21B 23/01
USPC ..... 166/117.7, 210, 215, 216, 382, 211
See application file for complete search history.

(56) References Cited

U.S. PATENT DOCUMENTS

| | | | | |
|---|---|---|---|---|
| 4,901,793 | A | 2/1990 | Weber | |
| 5,275,239 | A | 1/1994 | Obrejanu | |
| 5,636,690 | A | 6/1997 | Garay | |
| 5,902,378 | A | 5/1999 | Obrejanu | |
| 5,964,286 | A | 10/1999 | Cuppen | |
| 6,016,866 | A * | 1/2000 | Kaltwasser | 166/241.4 |
| 6,189,610 | B1 | 2/2001 | LaClare et al. | |
| 6,681,853 | B2 | 1/2004 | Doyle et al. | |
| 6,722,428 | B2 * | 4/2004 | Yokley | 166/217 |
| 7,121,350 | B2 | 10/2006 | Aldridge et al. | |
| 7,748,447 | B2 | 7/2010 | Moore | |
| 7,900,708 | B2 | 3/2011 | Obrejanu | |
| 2005/0115713 | A1 * | 6/2005 | Restarick et al. | 166/313 |
| 2006/0090905 | A1 * | 5/2006 | Brennan et al. | 166/387 |

FOREIGN PATENT DOCUMENTS

| | | | |
|---|---|---|---|
| CA | 2137336 | A1 | 6/1996 |
| CA | 2224505 | A1 | 6/1999 |
| CA | 2254480 | A1 | 5/2000 |
| CA | 2355555 | A1 | 1/2003 |
| CA | 2526820 | | 5/2007 |
| CA | 2526820 | A1 | 5/2007 |
| EP | 1371810 | A1 | 12/2003 |
| WO | 2010045722 | A1 | 4/2010 |

OTHER PUBLICATIONS

Kudu XF Anchor, Xtreme Flow Area Torque Anchor, Feb. 2011.

* cited by examiner

*Primary Examiner* — Giovanna C Wright
*Assistant Examiner* — Kristyn Hall
(74) *Attorney, Agent, or Firm* — Kunzler Law Group, PC

(57) ABSTRACT

Disclosed herein is a tubing string anchor for resisting angular rotation of the tubing string, as when undergoing pumping through the string. The anchor includes a plurality of anchoring members each rotatable about a fulcrum between a locking position and a non-locking position. The anchor housing has a groove formed between adjacent anchoring members through which a string may be run to access below the anchor when the anchor is installed.

10 Claims, 7 Drawing Sheets

ANCHOR FOR A TUBING STRING AND METHOD

CROSS-REFERENCE TO RELATED APPLICATION

This application claims the benefit of U.S. Provisional Patent Application No. 61/383,270, filed Sep. 15, 2010, which is incorporated herein by reference.

FIELD

The invention relates to wellbore tools and, in particular, a wellbore anchor for anchoring a tubing string to a wall of a wellbore in which it is installed.

BACKGROUND

A tubing string is commonly used to collect oil from wellbore formation. With low-pressure reservoirs, a pump will be installed in-line in the tubing string to force the oil upwardly through the tubing string's inner diameter to the surface. A pump may include a stator threaded into the tubing string and an internal helical rotor oriented within stator. The rotational forces on the rotor to move oil through the pump are reacted in an opposite direction through the stator into the tubing string. This tends to rotate the tubing string, which is undesirable.

Many anchors are available for preventing rotation of a tubing string. For example, one such anchor is described in U.S. Pat. No. 4,901,793.

U.S. Pat. No. 5,275,239 teaches another anchor for preventing rotation of a tubing string. That anchor provides a simple and reliable tool for anchoring a tubing string to a well casing. The anchor can readily disengage from the well casing and is durable. However, the anchor body accommodates much of the inner diameter of the wellbore such that access past the anchor is restricted and sometimes impossible.

SUMMARY

In one aspect, the invention provides a tool for anchoring a tubing string within a well casing against rotation in a predetermined angular direction, comprising: a housing adapted to be installed in-line in the tubing string for rotation with the tubing string and having an outer surface, a first end and an opposite end; a first anchoring mechanism and a second anchoring mechanism spaced circumferentially from the first anchoring mechanism about the housing, each of the first and the second anchoring mechanisms comprising: (a) a recess in the outer surface of the housing formed within a raised region of the housing; (b) an anchoring member within the recess and comprising a bite portion external to the recess, the anchoring member being shaped for displacement at least by rotation relative to the recess between a locking position in which the bite portion bites into the well casing and the anchoring member acts between the well casing and the housing to prevent rotation of the housing and a non-locking position in which the bite portion slides against the well casing in response to rotation of the housing in an opposite angular direction; (c) a retaining member preventing the anchoring member from escaping from the recess; and, (d) a biasing member acting between the housing and the anchoring member for urging the bite portion into contact with the well casing such that rotation of the housing relative to the well casing in the predetermined angular direction displaces the anchoring member to its locking position and rotation of the housing relative to the well casing in the opposite angular direction displaces the anchoring member to its non-locking position; and a longitudinally extending groove on the outer surface positioned circumferentially between the first anchoring mechanism and the second anchoring mechanism.

In another aspect, the invention provides a method for positioning a wellbore assembly in a well lined with well casing, the method comprising: positioning a tubing string assembly in the well, the tubing string assembly including a tool for anchoring a tubing string within the well against rotation in a predetermined angular direction, comprising: a housing installed in-line in the tubing string for rotation with the tubing string and having an outer surface, a first end and an opposite end; a first anchoring mechanism and a second anchoring mechanism spaced circumferentially from the first anchoring mechanism about the housing, each of the first and the second anchoring mechanisms comprising: (a) a recess in the outer surface of the housing formed within a raised region of the housing; (b) an anchoring member within the recess and comprising a bite portion external to the recess, the anchoring member being shaped for displacement at least by rotation relative to the recess between a locking position in which the bite portion bites into the well casing and the anchoring member acts between the well casing and the housing to prevent rotation of the housing and a non-locking position in which the bite portion slides against the well casing in response to rotation of the housing in an opposite angular direction; (c) a retaining member preventing the anchoring member from escaping from the recess; and, (d) a biasing member acting between the housing and the anchoring member for urging the bite portion into contact with the well casing such that rotation of the housing relative to the well casing in the predetermined angular direction displaces the anchoring member to its locking position and rotation of the housing relative to the well casing in the opposite angular direction displaces the anchoring member to its non-locking position; and a longitudinally extending groove on the outer surface positioned circumferentially between the first anchoring mechanism and the second anchoring mechanism; rotating the tool relative to the well casing in the predetermined angular direction to displace the anchoring members to the locking positions and to form an axially extending space between the longitudinally extending groove and the well casing; and running a string into the well and through the axially extending space to access a portion of the well below the tool.

Reference throughout this specification to features, advantages, or similar language does not imply that all of the features and advantages that may be realized with the subject matter of the present disclosure should be or are in any single embodiment. Rather, language referring to the features and advantages is understood to mean that a specific feature, advantage, or characteristic described in connection with an embodiment is included in at least one embodiment of the present disclosure. Thus, discussion of the features and advantages, and similar language, throughout this specification may, but do not necessarily, refer to the same embodiment.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

Figure 1:
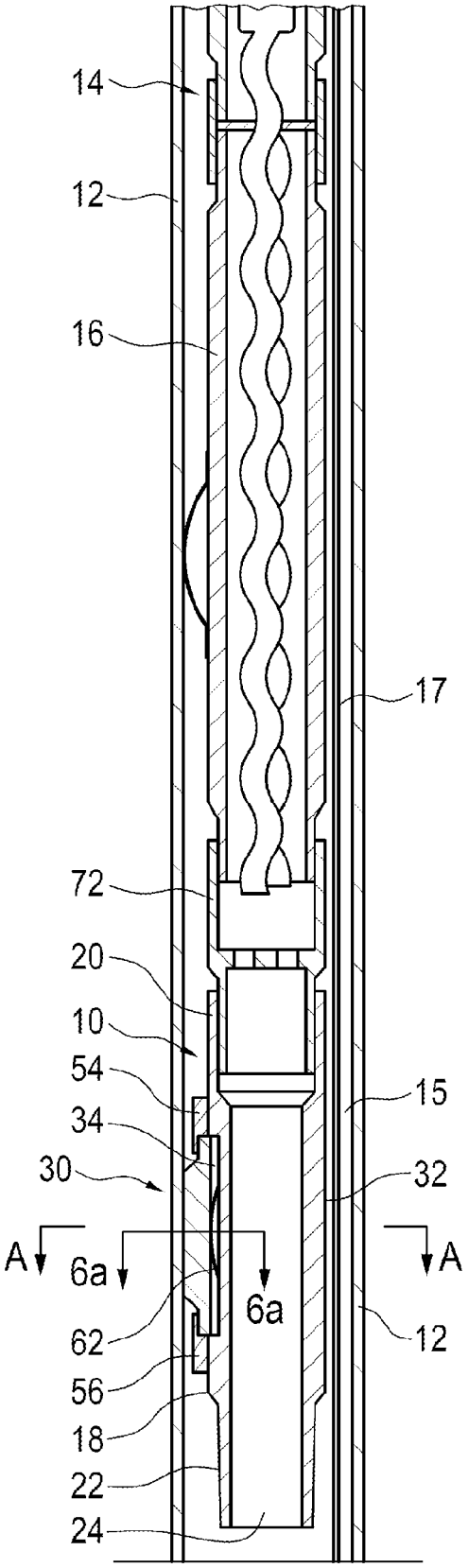
FIG. 1 is a diagrammatic cross-section in a vertical plane, stripped of detail, of an anchor located within a well casing.
Figure 2:
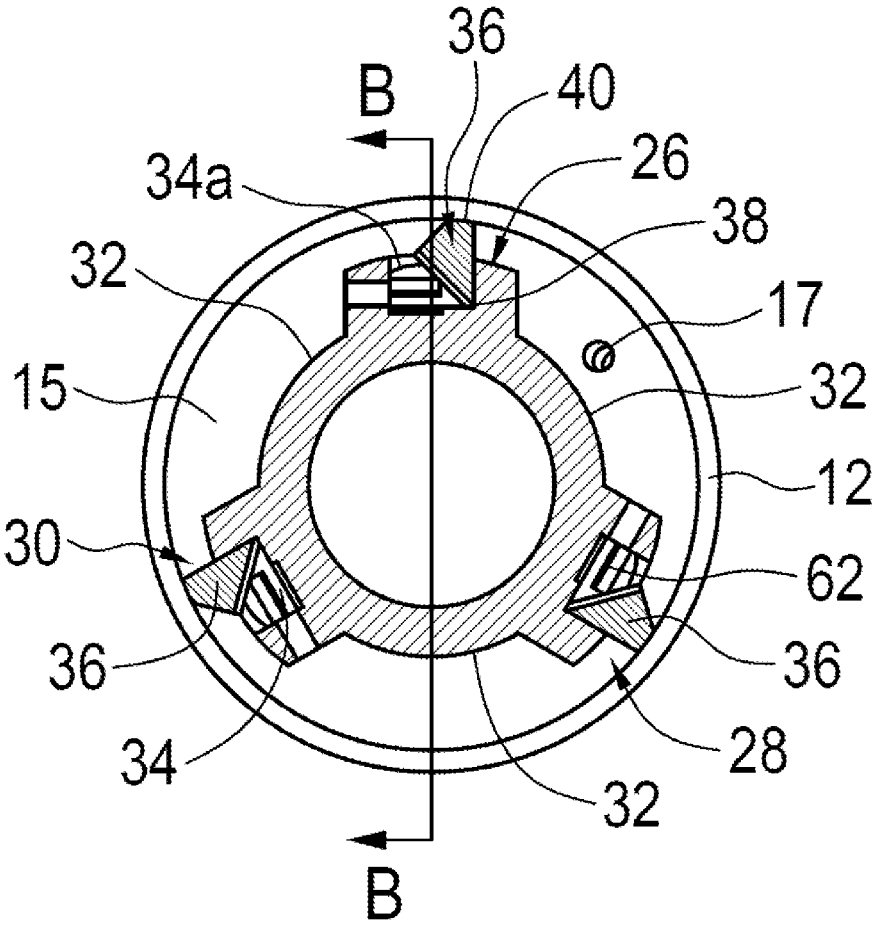
FIG. 2 is an orthogonal section through an anchor in a well casing (see line A-A in FIG. 1)
Figure 3:
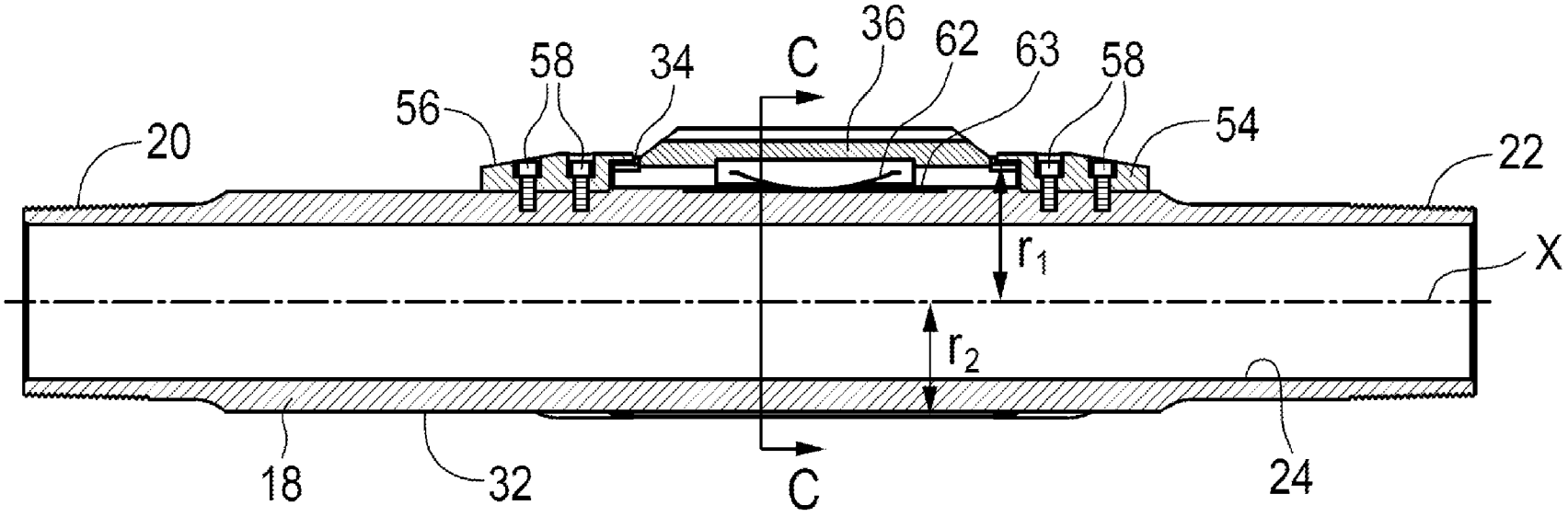
FIG. 3 is a sectional view along line B-B of the anchor of FIG. 2.
Figure 4:
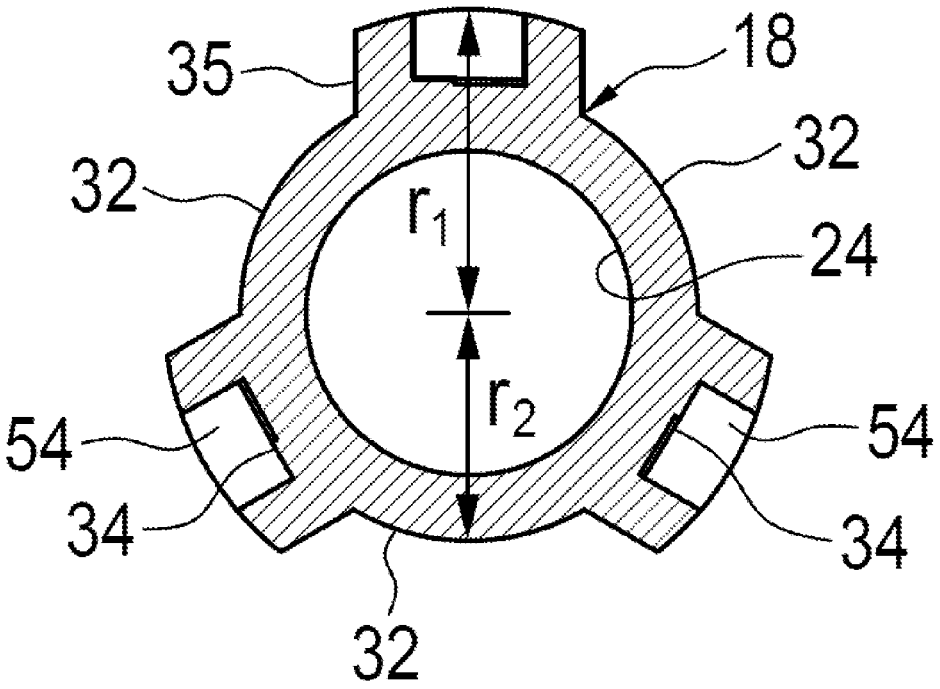
FIG. 4 is a section along line C-C of the anchor of FIG. 3 with the anchoring members removed.
Figure 5:
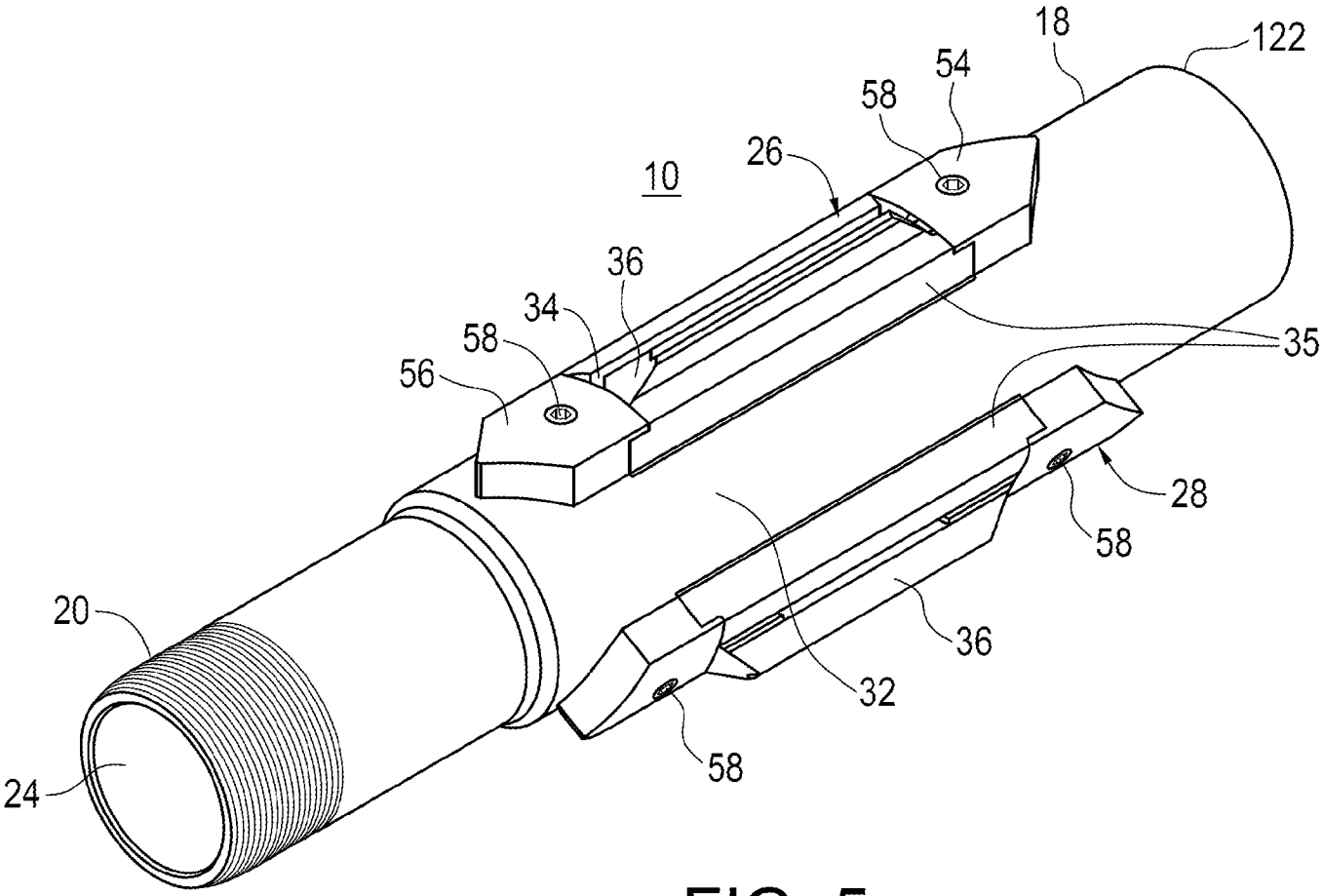
FIG. 5 is a perspective view of an anchor similar to FIG. 2, but having one pin end 20 and one box end 122.
Figure 6A:
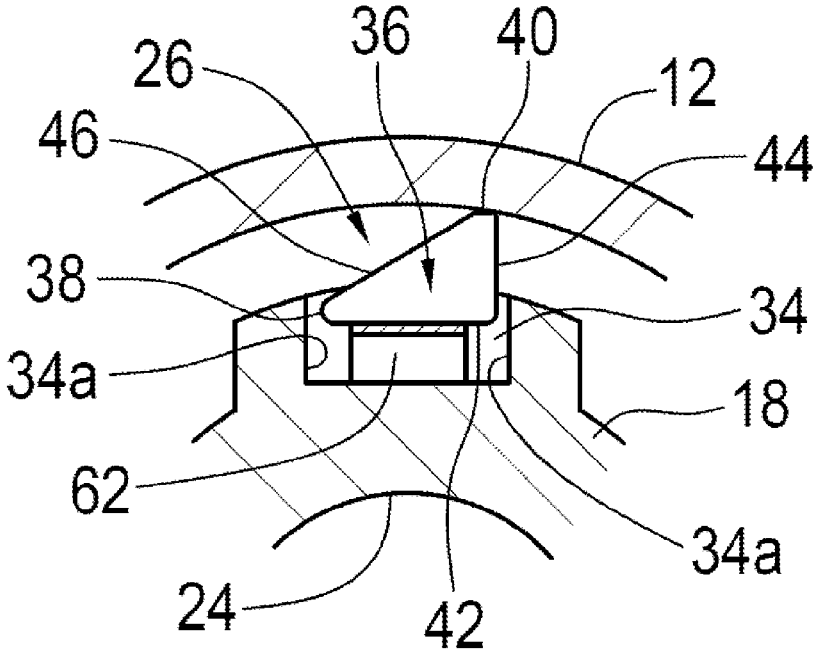
FIGS. 6*a* and 6*b* are orthogonal sectional views through the anchor respectively showing it unlocked from the well casing and locked to the well casing to resist rotation of the associated tubing string (see line 6*a*-6*a* in FIG. 1)
Figure 6B:
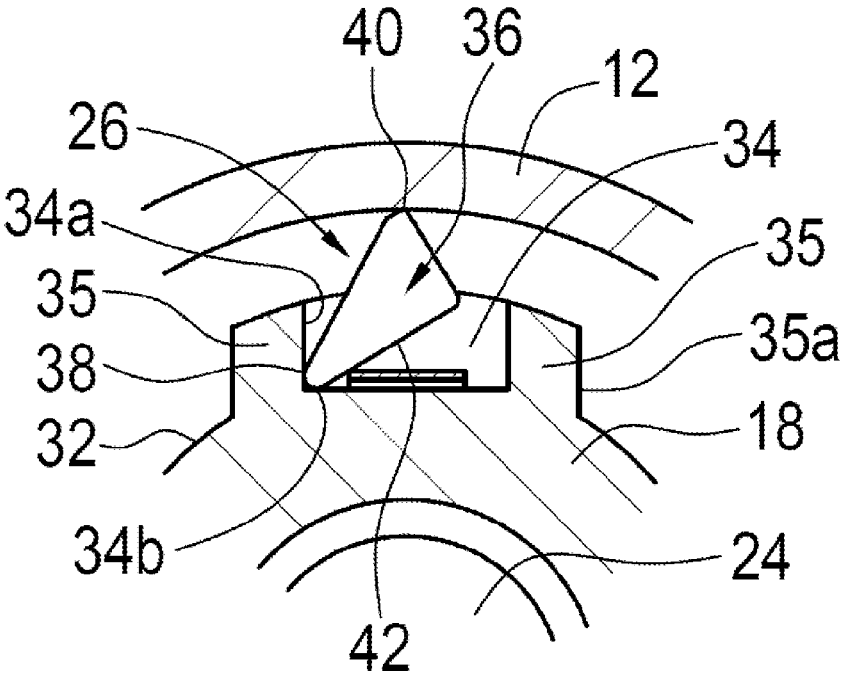

The description that follows and the embodiments described therein are provided by way of illustration of an example, or examples, of particular embodiments of the principles of various aspects of the present invention. These examples are provided for the purposes of explanation, and not of limitation, of those principles and of the invention in its various aspects. The drawings are not necessarily to scale and in some instances proportions may have been exaggerated in order more clearly to depict certain features. Throughout the drawings, from time to time, the same number is used to reference similar, but not necessarily identical, parts.

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

The invention relates to a tool for anchoring a tubing string within a well casing, the anchoring effect being against rotation in a predetermined angular direction. The anchor includes a housing adapted to be installed in-line in the tubing string for rotation with the tube string. A plurality of anchoring mechanisms is spaced circumferentially about the housing.

The housing of the anchor thins between at least one pair of adjacent anchoring mechanisms such that a concave groove is formed that extends from end to end on the housing. Such a groove causes the outer radial length of the tool to vary depending on the location of the measurement. The groove creates an axial space between the anchor and the casing, such that access can be achieved past the anchor even while it is installed in a wellbore. For example, wellbore strings, such as tubing, lines, tools, etc., can be inserted through the axial space alongside the anchor, formed by the groove, while it is in position in a well.

Each anchoring mechanism comprises a recess in the outer surface of the housing that contains an anchoring member. Each recess includes a pair of facing, substantially parallel side walls and a pair of end walls, spanning the side walls. The form of the side walls and end walls gives the recess a generally elongate appearance.

Each anchoring member has a bite portion and a base. When installed in the recess, the bite portion extends out from the recess, while the base is within the recess. Each anchoring member is shaped for displacement between a locking position in which its bite portion bites into the well casing and the anchoring member acts between the well casing and the housing to prevent rotation of the housing, and thus the tubing string, and a non-locking position in which its bite portion slides against the well casing to allow rotation of the housing, and thus the tubing string. Retaining member prevents the anchoring member from falling out of the recess. Biasing member urges the bite portion into contact with the well casing such that rotation of the housing in the predetermined angular direction displaces the anchoring member to its locking position and rotation of the housing in the opposite angular direction displaces the anchoring member to its non-locking position. In one form of the invention, each anchoring member is freely moveable within its associated recess. The term "freely moveable" as used in this specification in respect of an anchoring member indicates that the anchoring member is a separate component that is free both to rotate and translate within its associated recess. The retaining member may simply be one or more structures that partially overlay the recess, and the biasing member may incidentally urge the anchoring member against the retaining member when the anchoring member is in its non-locking position. The biasing member may simply resist and bias movement of the anchoring member.

A seating structure may be formed in the associated recess to receive the base, which acts as a fulcrum portion of the anchoring member. In the locking position, the fulcrum portion seats in the seating structure and the bite portion simultaneously bites into the well casing. In the non-locking position, the fulcrum portion is spaced outwardly from the seating structure and is rotated in the predetermined angular direction relative to the seating structure. The spring-biased contact between the bite portion and the well casing causes the anchoring member to rotate in an angular direction opposite to whatever direction the tubing string and housing are rotated. When the tubing string is rotated in the predetermined angular direction, the anchoring member is rotated in the opposite direction and translated inwardly to its locking position. When the tubing string is rotated in the opposite angular direction, the anchoring member rotates in the predetermined angular direction and translates outwardly (in part under the influence of the biasing member), back to its non-locking position. The anchoring members can readily release from the well casing.

Reference is made to FIGS. 1 to 6, which show an anchor 10 within a stationary well casing 12. The anchor 10 is installed in-line in a production tubing string 14 extending substantially centrally through the interior of the well casing 12. In this particular application, the anchor 10 has been positioned immediately below a progressive cavity pump 16 (also installed in-line in the tubing string 14). Pump operation tends to rotate the tubing string 14 clockwise (as viewed from above). The anchor 10 is designed to resist such rotation in a manner described more fully below. Strings 17 can be inserted down alongside the anchor, if it is desired to access regions below anchor 10.

The anchor 10 comprises a generally cylindrical housing 18. Standard threaded fittings 20, 22, 122 adapt the housing 18 for in-line installation. The housing 18 has a hollow interior bore 24 that permits pumping of fluids through the anchor 10 itself. Three anchoring mechanisms 26, 28, 30 are substantially equally-spaced circumferentially about the outer surface of the housing 18. Although three mechanisms are shown, other numbers are possible, such as four or more.

The form and position of an anchoring mechanism is described with reference to mechanism 26. It comprises a vertical (i.e. axially-directed) recess 34 of generally rectangular shape formed in the outer surface of the housing 18. Each recess includes side walls 34*a*, extending parallel and facing each other.

An anchoring member 36 is located within the recess 34. As apparent from FIGS. 6*a* and 6*b* the majority of the elongate body of the anchoring member 36 has a generally triangular cross-section with three apex portions. One apex portion constitutes a fulcrum portion 38 and another constitutes a bite portion 40, the bite portion 40 extending externally of the recess 34. It has a base surface 42 and a pair of side surfaces 44, 46, one on either side of the base surface 42 and both extending to the bite portion 40. The bite portion 40 defines a flat sliding surface and a pair of cutting edges (in FIGS. 6*a* and 6*b*, the cutting edges have been omitted because of the scale of the drawings). The cutting edges are spaced in a clockwise direction from the sliding surface. As discussed more fully below, counter-clockwise rotation of the anchoring member 36 tends to engage the cutting edges with the well casing 12 while clockwise rotation tends to disengage the cutting edges and engage the sliding surface with the well casing 12.

The anchoring member 36 is freely moveable within the recess 34. Upper and lower retaining members 54, 56 prevent the anchoring member 36 from escaping from the recess 34. The members 54, 56 may be secured with bolts 58 that extend into clearance holes in the members 54, 56 and thread into the housing 18. The members 54, 56 extend partially over the recess 34, the upper member 54 having an extension that overlies an upper end of the recess 34, the lower member 56 having an extending flange that overlies an opposite lower end of the recess 34. The retaining members in this embodiment, also operate as end walls for the recess. In the illustrated embodiment, upper and lower retaining members each are discreet items, one of each for each recess.

A biasing member, such as spring 62, is located between the anchoring member 36 and the bottom of the recess 34. It acts between the housing 18 and the anchoring member 36, specifically its base surface 42, to urge the anchoring member 36 outwardly against the retaining members. Most significantly, the spring 62 urges the bite portion 40 to contact the well casing 12. Recess 34 may be formed to urge spring 62 into its active position. For example, a lower area 63 may be formed in the floor of the recess to urge the spring to one side of the recess.

Contact between the bite portion 40 and the well casing 12 displaces the anchoring member 36 in response to rotation of the housing 18, which tends to rotate with the tubing string 14. The anchoring member 36 tends to rotate in a direction opposite to that of the housing 18. Contact between the bite portion 40 and the well casing 12 also produces inward and outward translation of the anchoring member 36 (under the influence of the spring 62) within recess 34. As discussed more fully below, this is exploited to displace the anchoring member 36 between a locking position (as in FIGS. 2 and 6*b*) which resists clockwise rotation of the tubing string 14 and a non-locking position which allows counter-clockwise rotation of the housing 18.

In response to clockwise rotation of the tubing string 14, the anchoring member 36 rotates counter-clockwise and translates inwardly (overcoming the biasing force of the spring 62) to its locking position. As the anchoring member 36 approaches its locking position, its fulcrum portion 38 seats in a seating area of the recess, which in this embodiment is a corner 34*b* of the recess 34. Bite portion 40 then tends to rotate about its fulcrum portion 38 until the bite portion's cutting edges bite firmly into the well casing 12. This locks the housing 18 and tubing string 14 against further clockwise rotation. As apparent in FIG. 6*a*, the anchoring members of the other anchoring mechanisms 28, 30, operate simultaneously in a similar manner.

If the tubing string 14 is then rotated in an opposite angular direction (counterclockwise), the anchoring mechanism is restored to its non-locking position. Such counter-clockwise rotation can be initiated at the surface by rotating the tubing string 14, for example as when the tubing string 14 is to be withdrawn. The bite portion 40 responds initially by rotating about the fulcrum portion 38 in the clockwise direction, disengaging the cutting edges contacting the sliding surface of the bite portion 40 with the well casing 12. The sliding surface substantially defines essentially a cord of the inner circumference of the well casing 12, and exposes no sharp edges so that the anchoring member 36 is free to slide relative to the well casing 12. The anchoring members of the other anchoring mechanisms 28, 30 simultaneously release and slide in a similar manner.

Grooves 32 are formed on the housing outer surface between the anchoring mechanisms. Relative to the housing body about recesses, grooves 32 are inwardly concave portions of the housing outer surface, compared to a cylindrical outer shape, and are continuous along the length of the anchor, extending from end to end on the housing. The result of such grooves is that the housing has a radial length that varies circumferentially. Measured from the housing's center long axis X, the longest radial length r1 is at housing wall surrounding the anchoring mechanisms and the shortest radial length r2 is at the circumferential position between anchoring mechanisms. For example, the housing outer surface directly adjacent the recess 34 may have a thickness creating radial length r1 between the outer surface and axis X and the housing outer surface in the position centrally between the recesses of adjacent anchoring mechanisms may have a radial length shorter than r1. The housing's outer surface contour at the edge of the groove may step abruptly into the groove. However, the curvature of the housing surface leading into the grooves can be abruptly stepped or more gradual.

In one embodiment, the radial length r1 is selected to be 82% to 92% of the wellbore radius in which the anchor is to be used. This ensures that the anchoring members 36 need extend only slightly beyond the outer surface of the housing, because the greater the extension the greater the risk of failures. In such an embodiment, the radius r2 may be 70% to 84% of the wellbore radius in which the anchor is to be used. For example, in one embodiment, intended for use in casing of diameter 6.3 inches to 6.6 inches, r1 is 2.5 inches to 3.1 inches and r2 is 1.8 inches to 2.6 inches, which leaves about an inch of open space between the casing and the housing at the groove when the anchor is installed.

In the illustrated embodiment, recess side walls 34*a* are formed into raised areas 35 of the housing. The raised areas define a lateral wall thickness between side walls 34*a* and outer side walls 35*a* about the recesses which is sufficient to withstand the force generated when the anchoring member wedges into the locking position. The material thickness between the base of the recess and inner bore 24 is also sufficient to withstand the force generated when anchoring member 36 wedges into the seating corner. This thickness has been found to be about 0.5 inches to 1.0 inches.

The grooves 32 between mechanisms 26, 28, 30 are defined as the thinner housing wall portions between the raised areas 35 about the recesses 34. In the illustrated embodiment, the raised areas are formed with abruptly stepped walls such that the inward curvature to the grooves is abrupt.

Retaining members 54, 56 are positioned at the end of the recess and span across raised areas 35 about the recesses 34. Retaining members 54, 56 also define radial distances greater than those at grooves such that members 54, 56 protrude beyond the surface of grooves 32. Upper and lower retaining members 54, 56 have a width no greater than the width from the wall 35*a* on one side of the recess to the wall 35*a* on the other side of the recess, such that they do not restrict the circumferential span of the grooves.

In the illustrated embodiment, ends of the housing above and below each recess have a wall thinned to a thickness similar to that at grooves 32. This reduces material requirements, weight, etc. Thus, upper retaining member 54 protrudes beyond the housing outer surface immediately above it and lower retaining member 56 protrudes beyond the housing outer surface immediately below it. The ends of members 54, 56 may be tapered forming wedge shaped leading ends.

When in place in a well casing, anchoring mechanisms 26, 28, 30 substantially centralize the housing in the well. Grooves 32 create longitudinal passages past the anchor. The passages created by grooves 32 are sized to permit work or fluid strings, such as wireline, coiled tubing, tools, etc., to be passed alongside the anchor.

In operation, the anchor 10 is introduced into the well casing 12 at the surface. The anchor 10 is held stationary, and the next section of the tubing string 14, the pump 16, is threaded to the housing 18 of the anchor 10 (through an appropriate coupler 72). Succeeding tube sections are threaded into the tubing string 14, and the assembly is lowered in a conventional manner along the well casing 12. Should locking occur during installation, the tubing string 14 can be rotated counter-clockwise to release the anchoring mechanisms 26, 28, 30. Once the anchor 10 and pump 16 are at the desired depth, the tubing string 14 can be rotated clockwise from the surface to place the anchoring mechanisms 26, 28, 30 in their locking position. Operation of the pump 16, which drives rotation of string 14, would in any event produce such a locking. Once in place, axial spaces 15 are formed between housing 18, at grooves 32, and casing 12. One or more strings 17 can be run in and installed alongside the anchor in the spaces to access portions of the well below the anchor. Because the grooves permit a typical space of 20% to 30% of the casing bore radius to be left open, in one embodiment, string 17 can have a diameter of up to about an inch, for example tubing as large as about 0.5 inches to about 1 inch can readily pass.

To release the anchor 10, the tubing string 14 is simply rotated counter-clockwise from the surface. The freely moveable nature of the anchoring members ensures reliable disengagement from the well casing 12, with little risk of damaging components.

Figure 7:
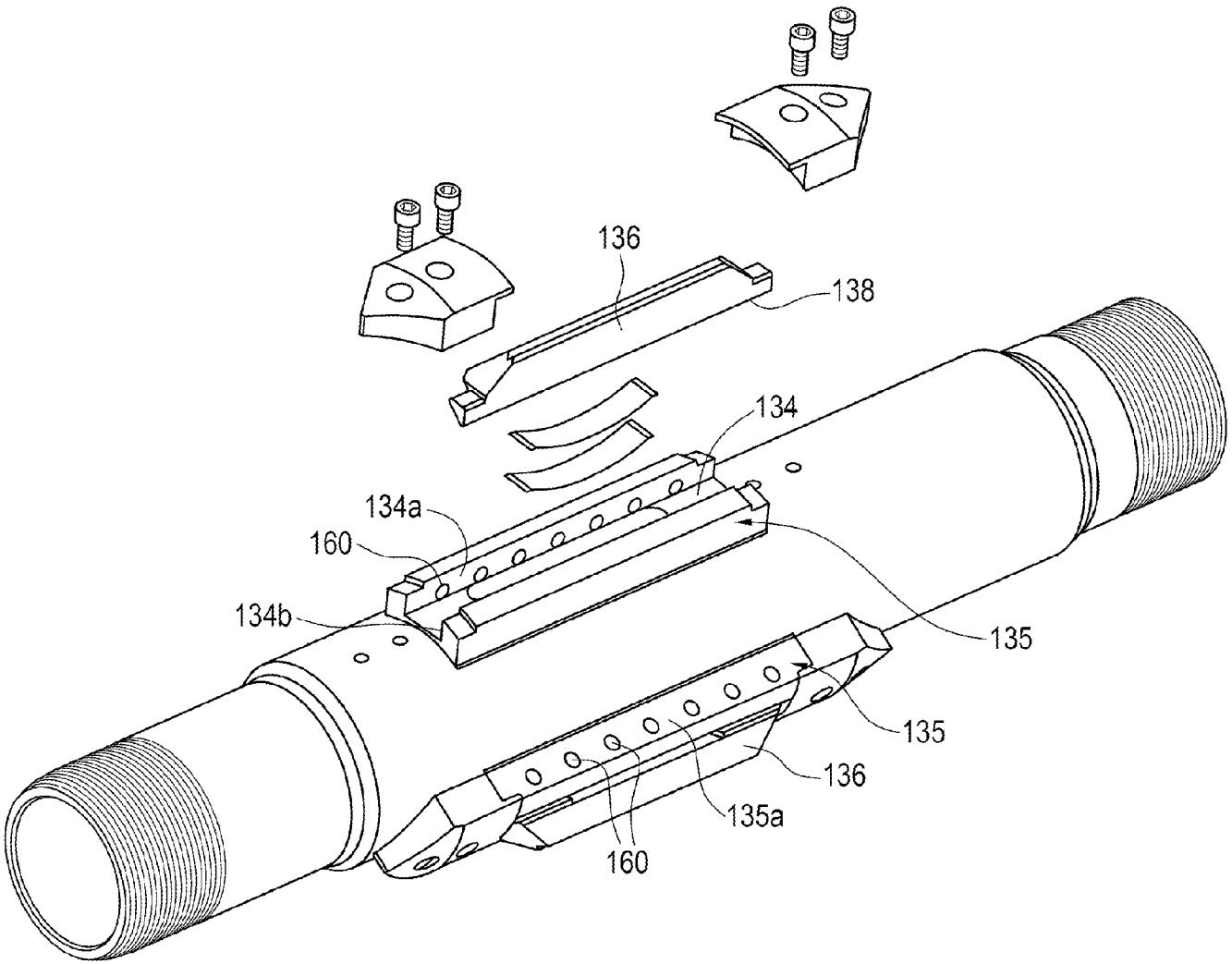
FIG. 7 is a perspective view of another anchor.

If debris tends to accumulate in the recess, a cover or liner may be provided over the spring. In one embodiment, illustrated in FIG. 7, ports 160 are formed through raised areas 135 forming the recess 134 side walls. Ports 160 are open and extend through the raised area on each recess from inner facing walls 134*a* to the outer facing wall surface 135*a*. Ports 160 provide for fluid and debris flow into and out of recess 134. While ports 160 can be variously formed and positioned, in one embodiment ports 160 can be provided to open directly adjacent the floor of the recess and on the side of the recess opposite the seating corner 134*b* in which the fulcrum portion 138 of the anchoring member 136 seats when in the locking position. Ports 160 for example, may be positioned to open into the port beneath the spring. Ports 160 are, therefore, positioned to allow evacuation of sand from beneath the anchoring member when it rotates down into the non-locking position. The risk of accumulation of sand, which tends to resist the unlocking of the anchor, may therefore be reduced.

Certain details of the preferred embodiment may not be associated with broader aspects of the invention. For example, each anchoring member could be retained with a pivot pin fixed to the housing 18. The motion of each anchoring member in response to rotation of the tubing string 14, between locking and non-locking positions, would then be purely rotational. Such pinning may not be preferred in some embodiments, as the pin is subjected to significant shearing forces that can lead to tool failure. The construction of the bite portion of each anchoring member can be any of various constructions. For example, the bite portion 40 of the anchoring member 36 in the illustrated embodiment uses sharp cutting edges, but any shape or construction that can grip the well casing 12 is appropriate. With a freely moveable anchoring member, seating of a distinct fulcrum portion in a distinct seating structure is preferred. However, such an anchoring member and associated recess need only have shapes that cooperate to halt rotation and translation of the anchoring member when the anchoring member achieves its locking position.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an", is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

What is claimed is:

1. A method for positioning a wellbore assembly in a well lined with well casing, the method comprising:

positioning a tubing string assembly in the well, the tubing string assembly including a tool for anchoring a tubing string within the well against rotation in a predetermined angular direction, comprising: a housing installed in-line in the tubing string for rotation with the tubing string and having an outer surface, a first end and an opposite end; a first anchoring mechanism and a second anchoring mechanism spaced circumferentially from the first anchoring mechanism about the housing, each of the first and the second anchoring mechanisms comprising: (a) a recess in the outer surface of the housing formed within a raised region of the housing; (b) an anchoring member within the recess and comprising a bite portion external to the recess, the anchoring member being shaped for displacement at least by rotation relative to the recess between a locking position in which the bite portion bites into the well casing and the anchoring member acts between the well casing and the housing to prevent rotation of the housing and a non-locking position in which the bite portion slides against the well casing in response to rotation of the housing in an opposite angular direction; (c) a lower retaining member forming a lower end wall of the recess and preventing the anchoring member from escaping from a lower end of the recess and an upper retaining member forming an upper end wall of the recess and preventing the anchoring member from escaping from an upper end of the recess, the upper retaining member including a backside against which the upper retaining member is secured to the outer surface of the housing and a side wall on each side of the backside, the width of the backside between the side walls tapers to define a wedge-shaped upper end pointing away from the recess; and, (d) a biasing member acting between the housing and the anchoring member for urging the bite portion into contact with the well casing such that rotation of the housing relative to the well casing in the predetermined angular direction displaces the anchoring member to its locking position and rotation of the housing relative to the well casing in the opposite angular direction displaces the anchoring member to its non-locking position; and a longitudinally extending bypass groove on the outer surface of the housing positioned circumferentially between the first anchoring mechanism and the second anchoring mechanism, wherein the lower retaining member and the upper retaining member each span across the raised area without spanning across and without projecting into the longitudinally extending bypass groove;

rotating the tool relative to the well casing in the predetermined angular direction to displace the anchoring members to the locking positions and to form an axially extending space between the longitudinally extending bypass groove and the well casing;

running a string into the well and through the axially extending space alongside the outer surface of the tool to access a portion of the well below the tool; and rotating the housing relative to the well casing in the opposite angular direction to rotate the anchoring member to its non-locking position and evacuating sand from beneath the anchoring member and from the recess to the axially extending space through ports extending from the recess to the longitudinally extending bypass groove, as the anchoring member rotates down into the non-locking position.

2. The method of claim 1 wherein the string has a diameter of between about 0.5 inch to about 1.0 inch.

3. The method of claim 1 wherein the string passes between the upper retaining member for the first anchoring mechanism and the upper retaining member for the second anchoring mechanism.

4. A tool for anchoring a tubing string within a well casing against rotation in a predetermined angular direction, comprising:

a housing adapted to be installed in-line in the tubing string for rotation with the tubing string and having an outer surface, a first end, an opposite end and a center axis extending between the first end and the opposite end;

a first anchoring mechanism, a second anchoring mechanism and a third anchoring mechanism, each spaced about the housing, each of the first, the second and the third anchoring mechanisms comprising:

(a) a recess in the outer surface of the housing formed within a raised region of the housing and a seating area;

(b) an anchoring member within the recess and comprising a bite portion external to the recess a fulcrum portion spaced from the bite portion, the anchoring member being shaped for displacement at least by rotation relative to the recess between (i) a locking position in which the bite portion bites into the well casing, the fulcrum portion seats in the seating area and the anchoring member acts between the well casing and the housing to prevent rotation of the housing and (ii) a non-locking position in which the bite portion slides against the well casing in response to rotation of the housing in an opposite angular direction;

(c) a lower retaining member forming a lower end wall of the recess and preventing the anchoring member from escaping from a lower end of the recess (d) an upper retaining member forming an upper end wall of the recess and including a flange protruding from the upper end wall and extending over a portion of the recess, the upper retaining member preventing the anchoring member from escaping from an upper end of the recess, the upper retaining member including a backside against which the upper retaining member is secured by a bolt to the housing; and, (e) a biasing member acting between the housing and the anchoring member for urging the bite portion into contact with the well casing such that rotation of the housing relative to the well casing in the predetermined angular direction displaces the anchoring member to its locking position and rotation of the housing relative to the well casing in the opposite angular direction displaces the anchoring member to its non-locking position;

longitudinally extending bypass grooves on the outer surface, one of the longitudinally extending bypass grooves positioned circumferentially between each of the first anchoring mechanism and the second anchoring mechanism, the second anchoring mechanism and the third anchoring mechanism and the third anchoring mechanism and the first anchoring mechanism, wherein the housing measured from the center axis to the outer surface has a radial length that varies circumferentially and includes a longest radial length defined surrounding and directly adjacent the recesses and a shortest radial length in the longitudinally extending bypass grooves and wherein the lower retaining member and the upper retaining member each span across the raised area without spanning across and without projecting into the longitudinally extending bypass grooves;

a lateral wall between each recess and each longitudinally extending bypass groove, the lateral wall having a wall thickness; and debris evacuation ports for each recess, the debris evacuation ports opening in a position adjacent the base of the recess below the biasing member and on a side of the recess opposite the seating area, the ports extend through the lateral wall to open on the outer surface.

5. The tool of claim 4 wherein the outer surface has a surface contour stepping abruptly into the longitudinally extending bypass groove.

6. The tool of claim 4 wherein the longitudinally extending bypass grooves each extend from the first end to the opposite end.

7. The tool of claim 4 further comprising recess side walls transitioning from the longitudinally extending groove to the raised region and the recess is positioned between the side walls and wherein the lower retaining member and the upper retaining member each span across the recess but have a width no greater than the distance between the side walls.

8. The tool of claim 4 wherein the lower retaining member includes a flange protruding from the lower end wall and extending over a portion of the recess.

9. The tool of claim 8 wherein the lower retaining member includes a tapered lower end.

10. The tool of claim 4 wherein the lower retaining member and the upper retaining member each span across the recess and each have a width no greater than the distance across the raised portion, the lower retaining member includes an extending flange that overlies a lower end of the recess and a wedge-shaped lower end opposite the extending flange.

* * * * *